US006035794A

United States Patent [19]

Keeton

[11] Patent Number: 6,035,794

[45] Date of Patent: Mar. 14, 2000

[54] AUTOMATIC COLLAR LOADING SYSTEM AND METHOD

[75] Inventor: John Herbert Keeton, Campbellsville, Ky.

[73] Assignee: Atlanta Attachment Company, Lawrenceville, Ga.

[21] Appl. No.: 09/148,919

[22] Filed: Sep. 4, 1998

[51] Int. Cl.[7] ..... D05B 21/00; D05B 27/10; D05B 35/10

[52] U.S. Cl. ..... 112/475.07; 112/305; 112/306; 112/470.29; 112/470.31

[58] Field of Search ..... 112/470.29, 470.31, 112/272, 305, 318, 322, 277, 475.03, 475.07, 475.05, 475.08, 475.09, 306

[56] References Cited

U.S. PATENT DOCUMENTS 5,269,257 12/1993 Yamazaki ..... 112/262.2
5,437,238 8/1995 Price et al. ..... 112/470.29
5,522,332 6/1996 Price et al. ..... 112/470.29
5,562,060 10/1996 Price et al. ..... 112/470.29
5,570,647 11/1996 Adamski, Jr. et al. ..... 112/470.31
5,622,129 4/1997 Sahl ..... 112/470.29
5,709,162 1/1998 Pagett et al. ..... 112/470.07

*Primary Examiner*—Peter Nerbun
*Attorney, Agent, or Firm*—Womble Carlyle Sandridge & Rice, PLLC

[57] ABSTRACT

A collar attachment station having an automatic collar loading system that includes a pair of guide rollers about which a circular collar is received. The guide rollers have a substantially conical construction and a roughened outer surface. As the guide rollers are rotated, the collar is drawn along the roughened surface of the guide rollers and into a sewing position beneath the sewing needle and presser foot of a sewing machine for the collar attachment station. A shirt body is placed over the collar and the collar and shirt body are expanded, and the edges of the collar and the neck opening of the shirt body are sewn together to attach the collar to the shirt body.

15 Claims, 6 Drawing Sheets

AUTOMATIC COLLAR LOADING SYSTEM AND METHOD

FIELD OF THE INVENTION

This invention relates in general to a system for attaching a circular collar to a shirt body. In particular, the present invention relates to an automatic collar loading system in which circular collars are positioned on drive rollers adjacent a sewing head and are automatically moved into sewing position with their edges aligned with each other and the sewing needle of the sewing head.

BACKGROUND OF THE INVENTION

In the production of garments in commercial or industrial settings, the garments are typically formed or sewn from a series of workpieces. The workpieces themselves typically are formed in batches of workpieces at a series of separate work stations, and then are transferred to further work stations where they are combined to form finished garments. For example, a tubular shirt body may be cut and sewn at a first work station after which the shirt body is conveyed to a separate collar attachment station for attaching a collar, such as a circular crew neck collar attached about the neck opening of the shirt body, and then the sleeves are attached to thus form a T-shirt or similar garment. The production of such garments typically is accomplished in a high volume, high speed operation in which consistently sized and high quality finished garments are desired at the end of the fabrication process. If defects are found in the garments, the garments generally will be rejected and therefore must be sold either as seconds or discarded. It is possible to try to remove the stitching of the garments and re-sew the pieces together to form the garment with the defects eliminated. However, such a process is extremely time consuming and generally still results in a garment that is considered a second or defective garment.

Increasingly, there have been attempts to automate various processes or steps in the fabrication of garments to try to insure greater reliability and consistency of quality of the garments while increasing production rates. There are, however, still certain sewing operations that are highly dependent on the skill of the operator to accurately position the garments prior to sewing. Such sewing operations thus have remained primarily manual operations.

For example, in the production of shirts with circular or crew neck collars, i.e. T-shirts, the loading of circular collars on a sewing system for sewing to a shirt body still must be done manually. For such an operation, a circular collar first must be manually positioned by the operator about a pair of drive rollers, and physically moved about the drive rollers by the operator to align and position the edges of the collar in the proper position with respect to the sewing needle prior to the start of the sewing operation. After the collar has been properly positioned, the operator then places a shirt body over the collar with the edges of the neck opening of the shirt body matched with the cut edges of the collar and the sewing needle. In addition, if the collar has a seam, the operator must physically orient the seam of the collar in a position upstream of the sewing needle in a position so as to be able to align the shoulder seam of the shirt body therewith.

The loading of the collar on the sewing station thus is a very time consuming portion of the collar attachment process, as the operator must insure that the rough or to-be-sewn edges of the collar are properly aligned with each other and with the sewing needle, are loaded under the presser foot, with any seam of the collar being positioned in the proper desired position for alignment with the shoulder seam of the shirt body prior to loading the shirt body on the rollers. Thus, careful attention and manipulation of the collar with both hands is required by the operator. As a result, the operator's production is greatly hampered by her ability to accurately load the collars beneath the presser foot and sewing needle of the sewing head.

Accordingly, a need exists for a system and method for automatically loading a collar into a sewing position beneath a sewing head without requiring an operator to manually manipulate and align the edges of the collar in a position for sewing, and to enable efficient and reliable loading of the collars on the sewing station while enabling the operator to simultaneously perform additional tasks, so as to increase and enhance the productivity of the sewing station while ensuring high quality and minimal defects.

SUMMARY OF THE INVENTION

Briefly described, the present invention relates to an automatic collar loading system for a collar attachment station at which a substantially circular fabric collar is attached to a garment such as a shirt body. Typically, each collar will be folded in half to form a circular band of material having folded edges and rough, to-be-sewn edges, and further can be formed with a seam. The shirt body generally will be a tubular fabric workpiece having a waist opening, shoulder openings, and a neck opening about which the collar is sewn by the collar attachment station. The collar attachment station generally includes a sewing machine mounted on a work table and has a sewing needle and presser foot and an electronic control system through which the operation of the sewing machine is controlled by an operator.

The automatic collar loading system is mounted to the sewing machine adjacent the sewing head thereof and generally includes first and second guide rollers or spindles rotatably mounted in spaced positions upstream and downstream of the sewing head. Each of the guide rollers has a substantially conical shape including a front conical portion and a rear cylindrical portion and is each generally formed from a material such as urethane, rubber, nylon or similar materials. The outer surface of each guide roller additionally is textured so as to provide a roughened or tacky finish. A substantially elliptical sewing path is defined about the guide rollers, about which the collar and shirt body are moved during a sewing operation for attachment of the collar to the neck opening of the shirt body.

The first or front guide roller is a drive roller and is mounted to a drive motor positioned along the sewing path upstream of the sewing needle of the sewing machine. The drive motor typically is an electric motor, although other types of motors can also be used, which rotates the first or drive roller so as to, in turn, cause the collar and shirt body to be rotated about the sewing path. The second or rear guide roller is an idler roller mounted to a support arm positioned downstream from the sewing needle. The idler roller is freely rotatable such that as the drive roller is rotated and pulls the collar and shirt body about the sewing path, the rear idler roller likewise is rotated. The support arm for the rear idler roller is pivotally mounted to an adjustment plate that is mounted to and movable along a guide track or slide plate to enable the position of the idler roller to be easily adjusted with respect to the drive roller, depending on the size of the collar to be sewn.

A tension cylinder is connected to the support arm for the rear guide roller and expands and contracts to move the rear guide roller in an arcuate motion between a first resting position and a second tensioning position along the sewing path. The tension cylinder generally is an air cylinder and has a cylinder rod connected to the support arm from the rear guide roller that is sufficiently pressurized prior to the start of sewing so as to provide a constant pinch or tension on the collar and shirt body as the shirt body and collar are moved about the sewing path, without stretching the neck opening of the shirt body. As a result, the collar and neck opening of the shirt body are substantially matched for sewing.

In addition, an expansion arm or member is pivotally mounted adjacent the front guide roller. The expansion member generally includes a horizontally extending rod or bar fixedly mounted to a pivoting support arm. A rotary vane actuator is connected to the support arm to cause the support arm to pivot and thus move the expansion member in an arcuate motion from a raised, contracted position adjacent the front drive roller and out of the sewing path to a lowered, expanded position extending into the sewing path in front of the drive roller. As the expansion bar is moved into its expanded position, it engages the collar and shirt body, causing the collar and shirt body to be expanded. This provides further tensioning of the collar and shirt body, as well as provides an open area along the shirt body to enable the operator to grasp and manipulate the collar and shirt body during the sewing cycle and for sewing off the collar and shirt body.

A treadle pedal control is pivotally mounted to the frame of the work table, positioned beneath the work table for engagement and operation by the foot of the operator. The treadle pedal generally is a conventional foot control pedal having heel back, neutral and toe forward positions. As the operator moves the treadle pedal between its heel back, neutral and toe forward positions, a control switch is actuated to the cause guide rollers to be rotated, the presser foot of the sewing head to be raised and lowered to enable the collar and shirt body to be positioned thereunder for sewing, and the sewing operation to be commenced. The treadle pedal and control switch are connected to the electronic control system for the collar sewing station, for controlling the operation of the sewing head in response to the movement of the treadle or control pedal.

In addition, a knee switch is mounted beneath the upper surface of the work table of the collar sewing station, in a position so as to be easily engaged by the knee of the operator. The knee switch generally is a pressure-sensitive switch, or pad, connected to the electronic control system for the collar sewing station. As the operator engages or actuates the knee switch, a control signal is sent to cause the tension cylinder to retract or expand and thus move the roller rear guide between a tensioning position and a rest or home position for loading to apply and remove tension from the collar. At the same time, the expansion member is caused to move between its contracted and expanded positions.

In use, the operator places the collar over the front or conical ends of the guide rollers with the rough or to-be-sewn edges facing inwardly toward the sewing head. The operator then moves the treadle pedal to its heel back position, which causes the guide rollers to be rotated for a preset time. The roughened surface of the guide rollers causes the fabric collar to be pulled upwardly along the length of the conical portions of the guide rollers and onto the cylindrical portions thereof, as the guide rollers are rotated so that the collar is automatically loaded onto the rollers and is moved into a sewing position within the sewing path, with its edges being aligned with each other and with the sewing needle of the sewing head. Simultaneously with the automatic loading of the collar onto the collar sewing station, the operator can retrieve and ready a shirt body for placement over the collar and about the guide rollers. At the end of the preset time delay, the rotation of the guide rollers is halted with the collar in its desired sewing position, whereupon the operator positions the neck opening of the shirt body under the presser foot and about the collar, with the neck opening aligned with the rough edges of the collar. The operator then engages the knee switch to expand the rollers and expansion member to tension the collar and shirt body for sewing. Thereafter, the operator initiates the sewing operation during which the collar is sewn to the shirt body. Toward the end of the sewing operation, the operator again engages the knee switch to cause the rollers and expansion member to retract and release the tension from the shirt body for sewing off the shirt body.

Various objects, features and advantages of the present invention will become apparent to those skilled in the art upon reading the following detailed description, when taken in conjunction with the accompanying drawings.

DETAILED DESCRIPTION

Figure 1:
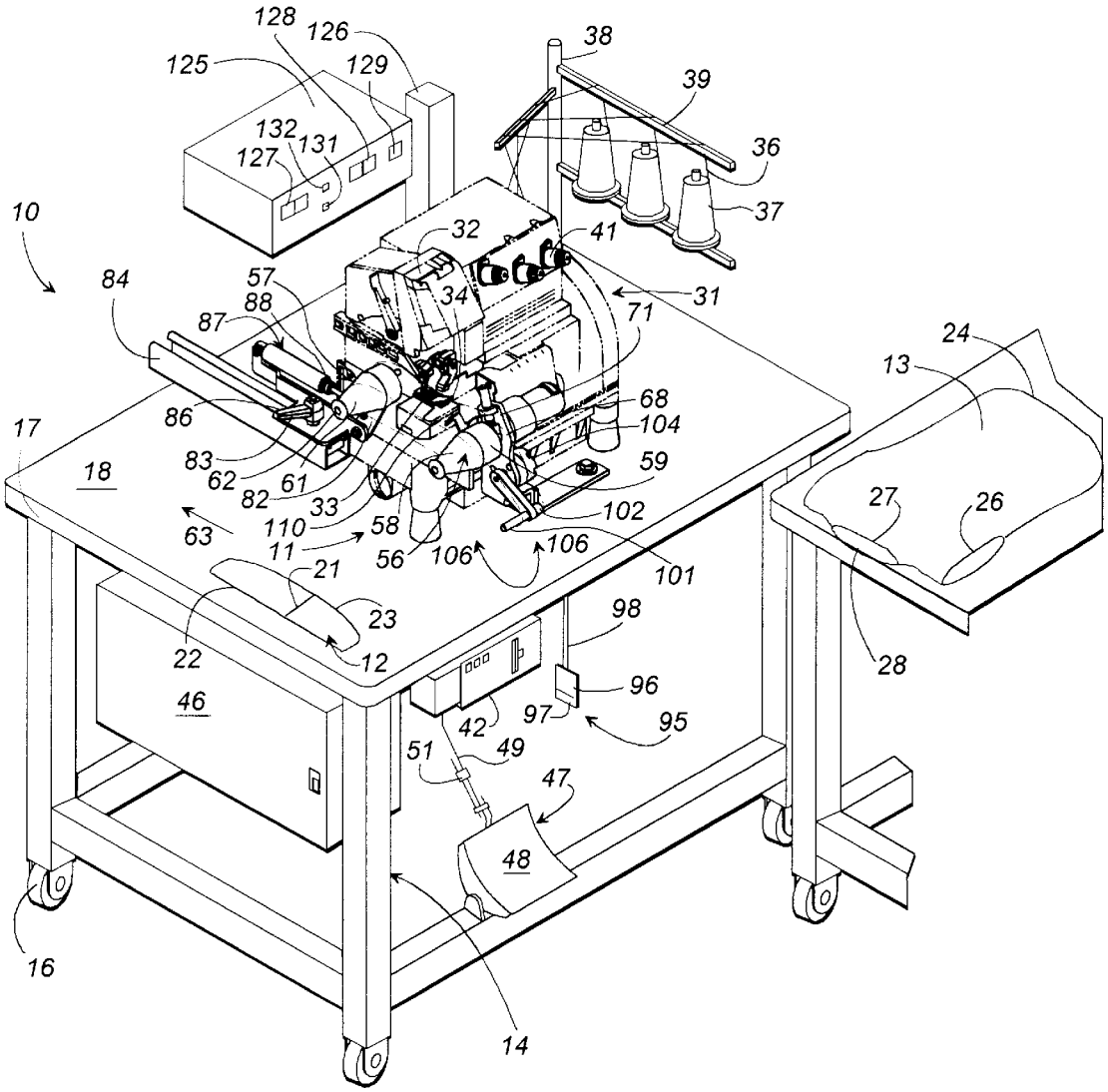
FIG. 1 is a perspective view of the collar sewing station with the automatic collar loading system of the present invention.

Referring now to the drawings in greater detail in which like numerals indicate like parts throughout the several views, FIG. 1 illustrates a collar attachment station 10 with automatic collar loading system 11 for attaching a circular collar 12 to a garment such as a shirt body 13. The collar attachment station generally includes a frame-work 14, typically formed from a metal such as steel, mounted on casters 16 and including a work table 17 having an upper work surface 18. The work surface typically provides sufficient area for stacking the collars 12 and shirt bodies 13 to be sewn together, although it is also possible, as shown in FIG. 1, to have the shirt bodies positioned in stacks (only one of which is shown) on an adjacent work table or in a bin for easy access by the operator.

Each collar 12 generally is a circular or tubular strip of a fabric material, such as cotton, having a natural elasticity. The collar generally is formed as a ring of material cut from a piece of fabric or initially formed as a strip of material with its ends being sewn together at a seam 21 to form the circular collar. Each collar is then folded over along a folded edge 22 and includes rough or to be sewn edges 23 that are matched together when the collars are folded for sewing. Each shirt body 13 generally is formed from a fabric material such as cotton and includes a waist portion 24, shoulder openings 26 and a neck opening 27 about which the collar 12 is sewn. As shown in FIG. 1, the neck opening of the shirt body has a substantially circular edge 28 that will be matched with and sewn to the rough edges 23 of the collar 12.

Figure 2:
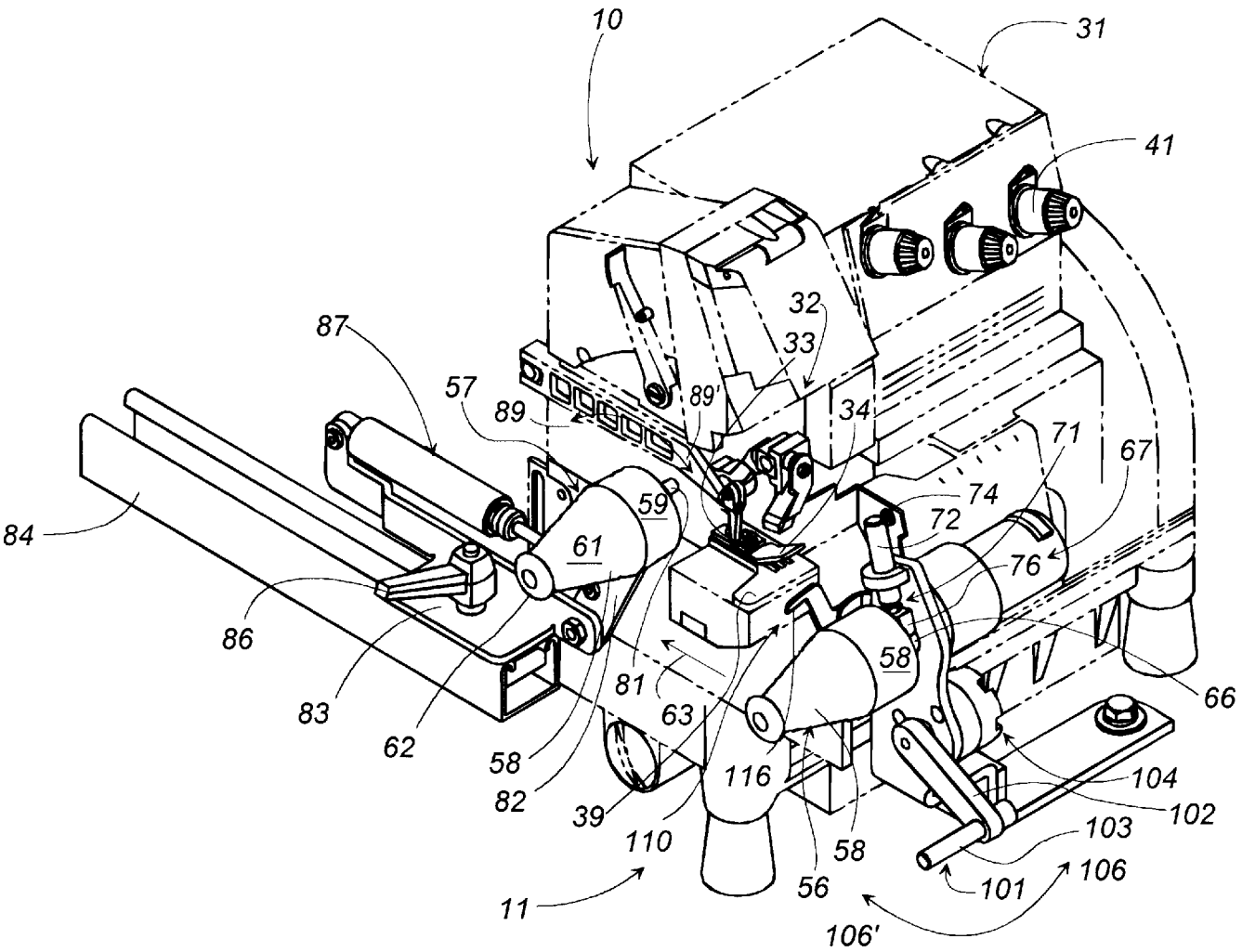
FIG. 2 is a perspective view of the sewing machine with the automatic collar loading system mounted thereto.

As illustrated in FIGS. 1 and 2, the collar attachment station 10 includes a sewing machine 31, mounted on the work table 17 (FIG. 1). The sewing machine generally is a conventional sewing machine such as manufactured by Yamato or Pegasas and which includes a sewing head 32 having a sewing needle 33 (FIGS. 2–4) and a presser foot 34. A series of threads 36 (FIG. 1), here shown as three, are fed from spools 37 mounted on a support 38 attached to the frame-work 14 of the collar attachment station. The threads 36 are fed through a series of thread guides 39 to a series of thread tensioners 41 for feeding to the sewing needle 33 (FIG. 2) and loopers (not shown) of the sewing machine. The sewing machine further includes a trimmer or cutter (not shown) mounted adjacent the sewing needle for trimming away excess fabric from the rough edges of the collar and for trimming the thread chain from the shirt body and collar at the completion of the sewing cycle. As shown in FIG. 1, a sewing machine drive 42 is mounted to the frame work of the collar attachment station 10, below the work surface 18 of the work table 17. The sewing machine drive typically is an electronic drive such as a Panaservo AC motor drive manufactured by Panasonic Corp. or similar drive as is conventionally known in the art.

A machine control system 46 is mounted to the framework 14 of the collar attachment station 10 for controlling the operation of the collar attachment station. Typically, the machine control system is a microprocessor based control that controls the operation of the sewing machine drive 42 and other functions of the sewing machine such as the raising and lowering of the presser foot 34 and starting and stopping of a sewing operation, as well as the operation of the automatic collar loading system 11. A treadle pedal control 47 is pivotably mounted to the frame work of the collar attachment station, as illustrated in FIG. 1, and connects to the control system 46. The treadle pedal generally is a conventional foot control pedal as is known in the art and includes an angled upper surface 48 on which the foot of an operator rests, and a linkage 49 extending from an upper edge of the treadle pedal. A contact switch 51, such as a standard snap switch manufactured by Microswitch, Inc. and as is known in the art is mounted along the linkage 49 of the treadle pedal 47 and is actuated upon movement of the treadle pedal between the neutral, at rest position as shown in FIG. 1, heel back first position and a toe forward position. As the treadle pedal is moved between its heel back, neutral and toe forward positions, signals are sent to the control system, which in turn controls the operation of the sewing machine and automatic collar loading system during a sewing operation.

Figure 3A:
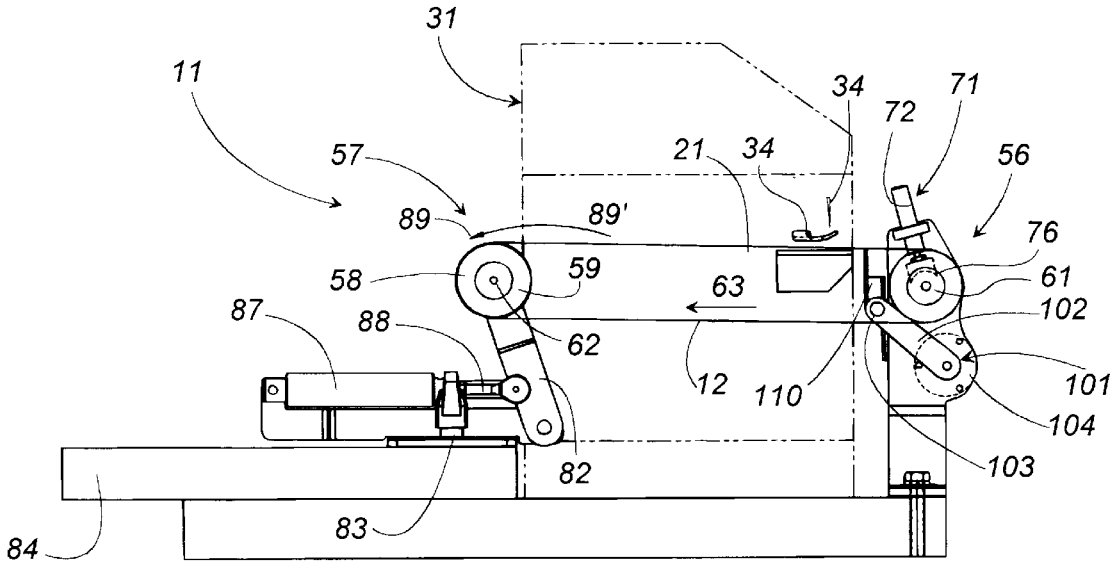
FIG. 3A is a side elevational view of the automatic collar loading system with a collar initially positioned thereon.
Figure 3B:
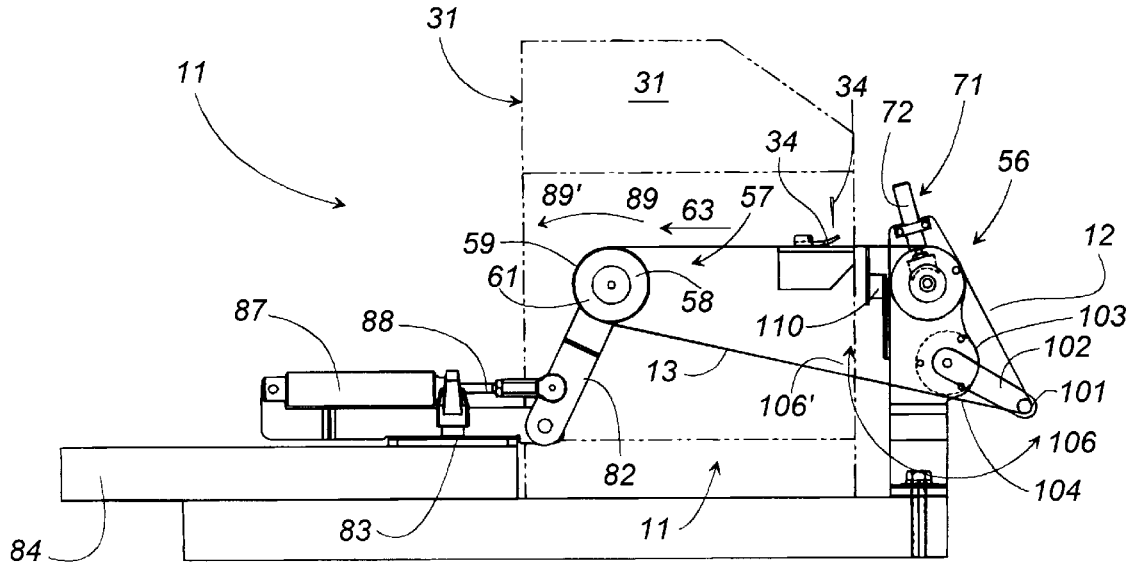
FIG. 3B is a side elevational view of the automatic collar loading system with the guide rollers and expansion member in their expanded, tensioning positions.
Figure 4:
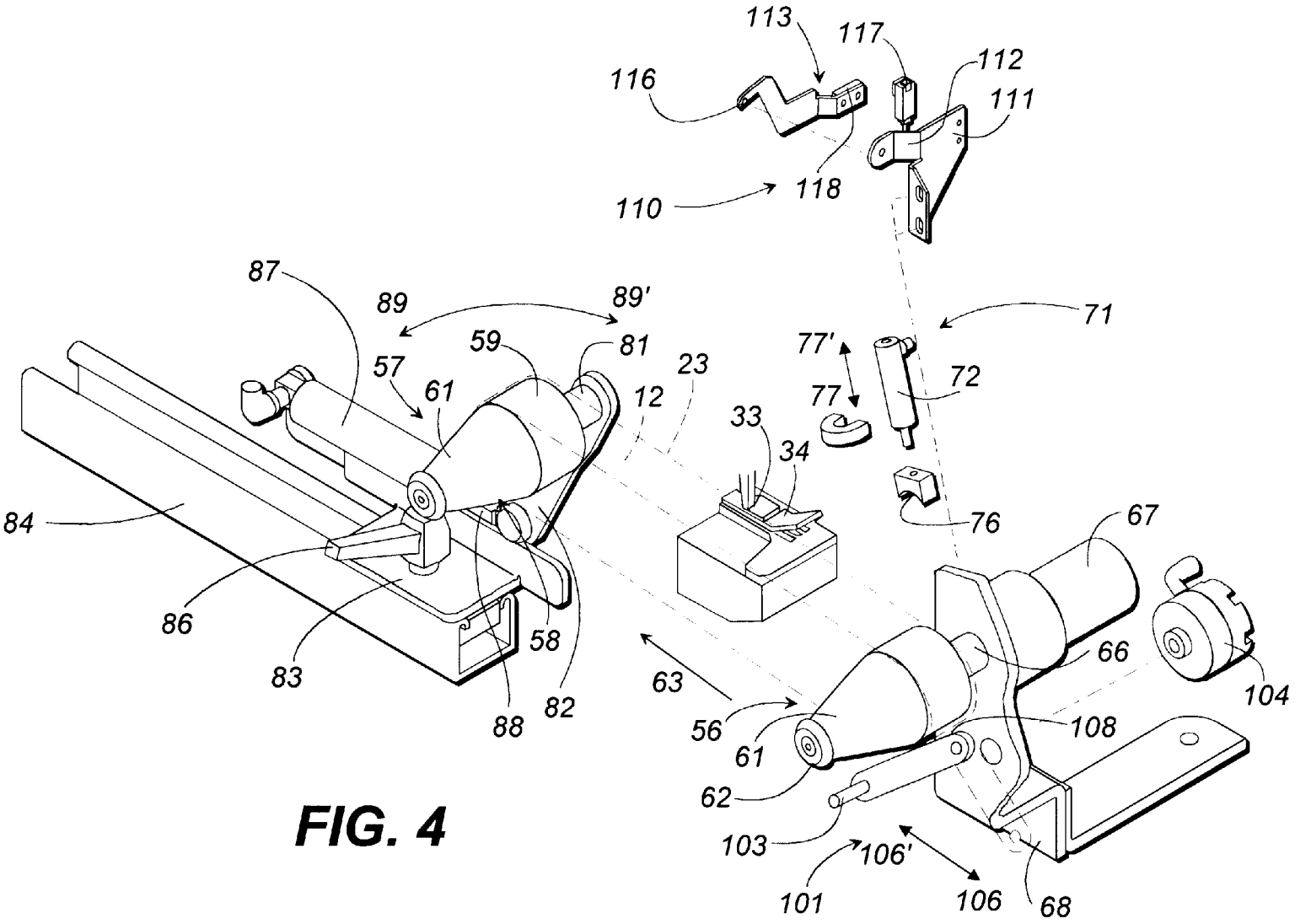
FIG. 4 is a perspective view schematically illustrating the automatic collar loading system and seam detector of the present invention.

FIGS. 2–4 illustrate the automatic collar loading system 11 for the collar attachment station 10. The automatic collar loading system includes a pair of guide rollers including a first or front guide roller 56 and second or rear guide roller 57 that are positioned upstream and downstream of the sewing head 32. Each guide roller generally is made from a material such as urethane, although it can also be manufactured from other materials such as rubber, nylon, or other plastic materials. Each guide roller has a substantially conical shape including a first or cone shaped front end 58 and a rear, substantially cylindrical shaped portion 59, and includes a textured or roughened surface, indicated by 61, such that as the drive rollers are rotated, the textured or rough surface of the guide rollers tends to pull a collar upwardly and along the length of the guide rollers from the cone shaped front end 58 toward the rear, cylindrical portion 59. Lock nuts 62 are attached to the cone shaped front ends of each guide roller and have a diameter that is slightly greater than the diameter of the front portion of each of the cone shaped ends of the rollers to prevent the collars from sliding off the front ends of the cone shaped portions 58. An elliptical sewing path indicated by arrows 63 is defined about the cylindrical portions 59 of the guide rollers 56 and 57, extending beneath the sewing needle 33 and presser foot 34. As the guide rollers are rotated, they tend to pull the collar and shirt body about the sewing path in the direction of arrows 63.

The first or front guide roller 56 is a drive roller and is mounted on a drive shaft 66 for a driver motor 67 (FIGS. 2 and 4), which is mounted to a vertically extending support plate 68 positioned in front of the sewing machine 31 as shown in FIG. 2. The drive motor 67 typically is a 12 volt electric motor, such as is manufactured by Pitman Company, typically having a 6 to 1 gear ratio, although it will be understood by those skilled in the art that the types of motors such as air motors, gear motors, stepping motors and servomotors further can be used. The drive motor is connected to the machine control system and drives or rotates the drive roller 56 to cause the collar and shirt body to be moved along the sewing path 63 during the loading of the collar into the sewing path and during a sewing operation in response to the treadle pedal 47 (FIG. 1) being moved to its heel back and toe forward positions.

A roller brake assembly 71 (FIG. 4) is positioned above the drive shaft 66 for the front guide roller 56 or stopping the rotation of the roller at the end of a collar loading cycle and at the end of the sewing operation. The roller brake assembly 71 includes an air cylinder 72 that is typically a ⅜ inch bore cylinder having an approximately ½ inch stroke, such as is manufactured by Bimba, which has an extensible cylinder rod 73 and an air inlet valve 74 that connects the air cylinder to a pressurized air source (not shown). A substantially U-shaped brake pad or block 76 is mounted to the free end of the cylinder rod 73 (not shown) so as to be carried with the cylinder rod as it is extended and retracted in the direction of arrows 77 and 77' for moving the brake into and out of engagement with the drive shaft for the front guide roller. The brake pad 76 generally is manufactured from nylon or a similar nonslip plastic material and is sized and shaped to fit about and engage the drive shaft for the front guide roller and prevent further rotation of the guide shaft. Thus, as the drive motor is deactivated at the end of a collar loading cycle or sewing operation, halting the driving of the rollers, the roller brake is actuated at approximately the same time to engage the drive shaft and prevent further rotation and slippage to insure that the collar is halted in the proper, desired position with respect to the sewing needle for attachment to the shirt body.

The second or rear guide roller (FIGS. 2 and 4) is an idler roller 57 mounted on an idler shaft 81 so as to be freely rotatable, and is positioned downstream from the drive roller on the opposite side of the sewing needle therefrom. The idler shaft extends horizontally, perpendicular to the sewing path and is attached to a movable support plate 82 that is pivotably attached to an adjustable base plate 83. The base plate 83 and movable support plate 82 are generally made from a metal such as steel or similar material and are positioned perpendicular to one another. The base plate is received within and is movable along a U-shaped guide track 84 for adjusting the position of the movable support arm and idler roller 57 with respect to the drive roller 56 to accommodate varying size collars being sewn by the collar attachment station. A set screw or clamp mechanism 86 extends through the base plate and engages the guide track such that as the set screw is tightened, the base plate is locked into a set position with the idler roller 57 spaced a desired distance from the front guide roller. As illustrated in FIGS. 2–4, a tension cylinder 87 is mounted to the base plate, positioned adjacent the movable support plate and connected thereto. The tension cylinder generally is a conventional air cylinder, such as is manufactured by Bimba, having a ¾ inch bore with an approximately 1 inch stroke. The tension cylinder includes an extensible cylinder rod 88 that is extended and retracted therefrom and which is pivotably connected to the movable support plate 82 as indicated in FIG. 4. The tension cylinder is connected to the pressurized air supply for the collar attachment station and is pressurized at a sufficient air pressure such that the idler or rear guide roller 57 is moved outwardly in the direction of arrows 89 after the shirt body has been placed thereover to tension the collar and neck opening of the shirt body to remove any slack therefrom so that the rough or to be sewn edges of the collar substantially match the neck opening of the shirt body without over-tensioning or stretching the neck opening of the shirt body. The pressure exerted by the tension cylinder is only sufficient to move the idler roller 57 outwardly to a desired position whereby a substantially constant or slight tension or pinch is maintained on the shirt during sewing without over tensioning and stretching the shirt body. Typically this pressure will be between 10 to 80 psi, although greater or lesser pressures can be utilized as well, depending on the elasticity of the fabric of the collar and shirt body being sewn.

As shown in FIG. 1, a knee press switch 95 is mounted beneath the surface of the work table 17 in a position so as to be engaged by the knee of the operator. The knee press switch generally is a conventional electric foot switch such as is manufactured by Microswitch, Inc., having a base portion 96 and a pressure plate or pedal 97. The knee press switch is mounted to and supported by an adjustable support linkage 98 to enable the position of the knee press switch to be adjusted to fit the operator. Upon actuation of the knee press switch, the idler roller 57 is moved in the direction of arrows 89 and 89' (FIG. 3B) between a retracted, resting or home position illustrated in FIG. 3A and a tensioning position illustrated in FIG. 3B. The actuation of the knee press switch further initiates the movement of an expansion member 101 into and out of engagement with the shirt body and collar as illustrated in FIGS. 3A and 3B.

As shown in FIG. 2, the expansion member 101 generally includes a pivoting support arm 102 that is pivotably mounted to a drive shaft or pivot pin (not shown) that extends through the vertical support plate 68, and a horizontally extending bar or pin 103 typically formed from a metal such as aluminum or steel having a smooth, polished surface for engaging and enabling the collar and shirt body to slide thereover. A rotary vane actuator 104, or similar drive mechanism, is mounted to the rear side of the vertical support plate 68 and is attached to the drive shaft or pivot pin (not shown) for the arm 102 of the expansion member 101. The rotary vane actuator 104 typically is approximately size 110 millimeter air powered rotary actuator, such as is conventionally manufactured by SMC, and is capable of moving the arm of the expansion member about an approximately 270° arc. The rotary vane actuator is connected to the pressurized air supply for the collar attachment station and to the machine control system and is activated and deactivated with the engagement of the press switch 95 (FIG. 1) so as to be move the expansion member in the direction of arrows 106 and 106' (FIGS. 1, 2, and 4) from a raised, retracted position out of engagement with the collar 12 and shirt body 13, as illustrated in FIG. 3A, to a lowered, engaging position extending into the sewing path and contacting the collar and shirt body as illustrated in FIG. 3B.

The movement of the expansion member into its lowered, contacting position together with the outward movement of the idler roller 57 to its tensioning position, tensions the collar and shirt body for sewing, as well as provides an opening or gap into which the operator can insert his or her fingers to grip the collar and shirt body for manipulating the collar and shirt body during the sewing operation and sewing off of the shirt. It also will be understood by those skilled in the art that other types of expansion members, other than a pivoting arm, and other types of drive mechanisms such as electric or hydraulic motors and air cylinders can be used in place of the rotary actuator. For example, the expansion bar could be mounted on a slide connected to an air cylinder so that instead of being moved in an arcuate motion, the expansion member can be moved in a substantially straight, longitudinal motion into and out of engagement with the collar and shirt body.

As illustrated in FIGS. 2 and 4, a seam detector 110 is mounted along the sewing path slightly downstream from the front or drive roller 56. The seam detector includes a base plate 111 mounted to the vertical support plate 68 positioned at the front of the sewing machine and which has a projection or tab portion 112 that extends perpendicular to the sewing path. A trip arm 113 is pivotably attached to the projection 112 and includes a rear portion 114 that pivotally attaches to the projection 112, and a front bill portion 116 that projects laterally across the sewing path into a position such that the collar will pass thereover (FIG. 4). A proximity sensor 117, such as a photocell or contact sensor manufactured by Aromat, or similar detector, is mounted adjacent the projection or tab portion 112 of the base plate 111 in position to detect the movement of a contact 118 mounted to the rear portion 114 of the trip arm 113, and is connected to the machine control system. As the collar is moved about the sewing path during the collar loading operation, the seam detector, if active for use when collars having seams are being sewn, detects the movement of a seam within the collar passing thereover as a seam will tend to engage the front or bill portion 116 of the trip arm 113, causing the trip arm to be pivoted downwardly slightly and thus causing the contact 118 to move. This movement is detected by the proximity sensor 117 which indicates the passage of the seam over the seam detector. In response, the driving of the drive roller 56 (FIG. 4) during the initial collar loading operation is halted after a preset time delay following the engagement of the seam detector.

It is also possible to use other types of seam detectors as are known in the art in order to detect the presence of a seam within the collar to be sewn or controlling the collar loading operation as desired. If the collar does not have a seam, the seam detector is deactivated and the system will run for a preset or preprogrammed time as programmed by the operator between 0 to 3 seconds to insure the loading of the collar into a sewing position beneath the sewing needle.

As FIG. 1 illustrates, a control counter 125 is mounted on a vertically extending support 126 extending above the work surface 18 of the work table 17 for the frame-work 14 of the collar attachment station. The counter generally is a conventional control counter having a pair of input or data entry modules 127 and 128 that generally comprise thumb wheel switches for inputting a programmed run time for the driving of the guide rollers during a collar loading operation. A first one of the data entry modules, module 127, is programmed with a preset time interval between 0 to 3 seconds for controlling the driving of the guide rollers during a collar loading operation where the collar to be loaded does not have a seam formed therein. The second data entry module, module 128, is used for programming in a time interval between 0 to 3 seconds for controlling the rotation of the drive roller 56 (FIG. 4) for such programmed time interval following the detection of a seam within the collar by the seam detector. A switch 129 (FIG. 1) is provided for enabling and disabling the seam detector, and thus transferring control between the data entry modules, depending on whether the system is loading collars with or without seams. Additional control switches 131 and 132 are provided for switching between automatic and manual control and for resetting the collar attachment station.

OPERATION

Figure 5:
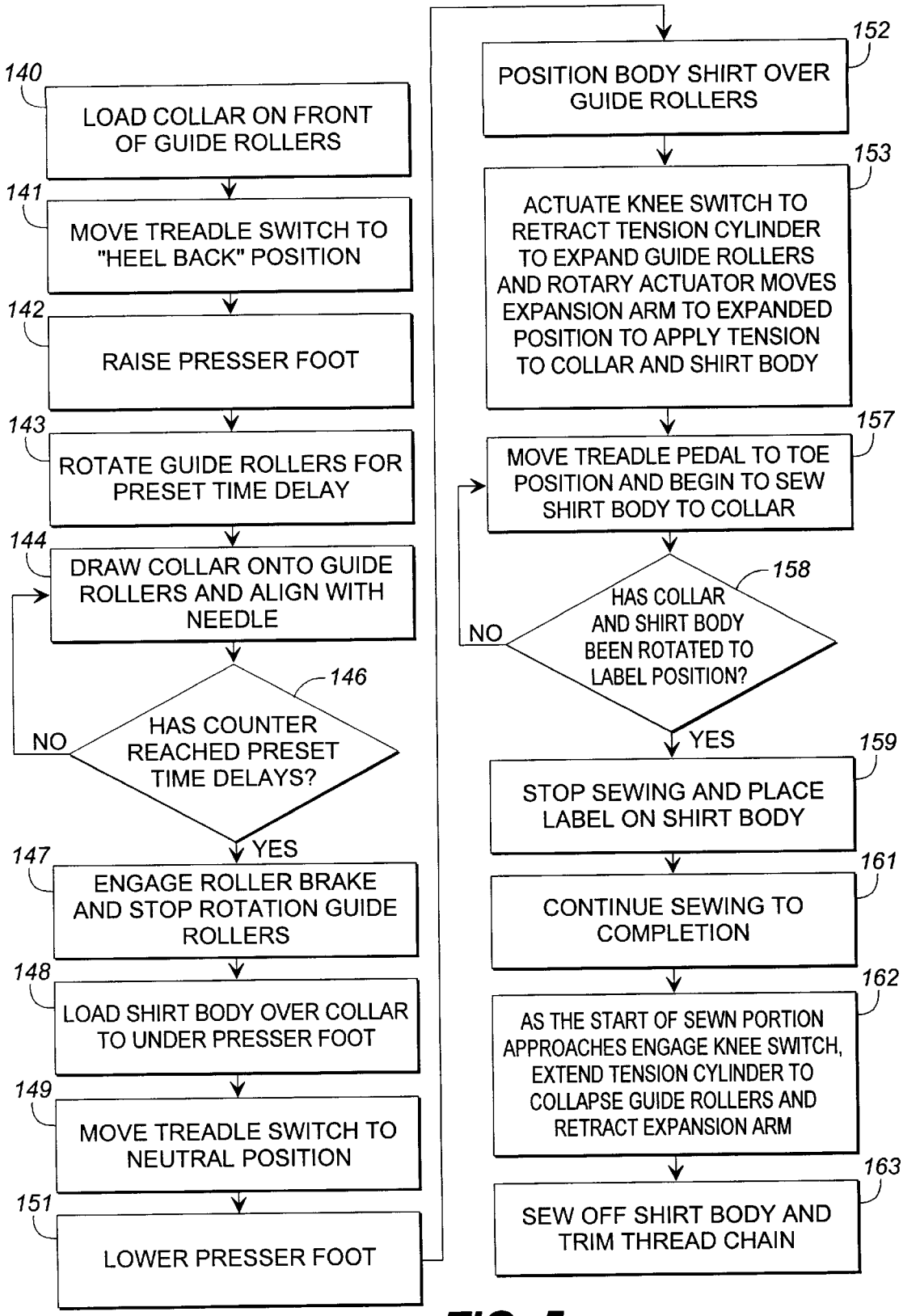
FIG. 5 is an operational flow diagram of the general operation of the collar sewing station with the automatic collar loading system of the present invention for use in sewing a seamless collar to a shirt body.
Figure 6:
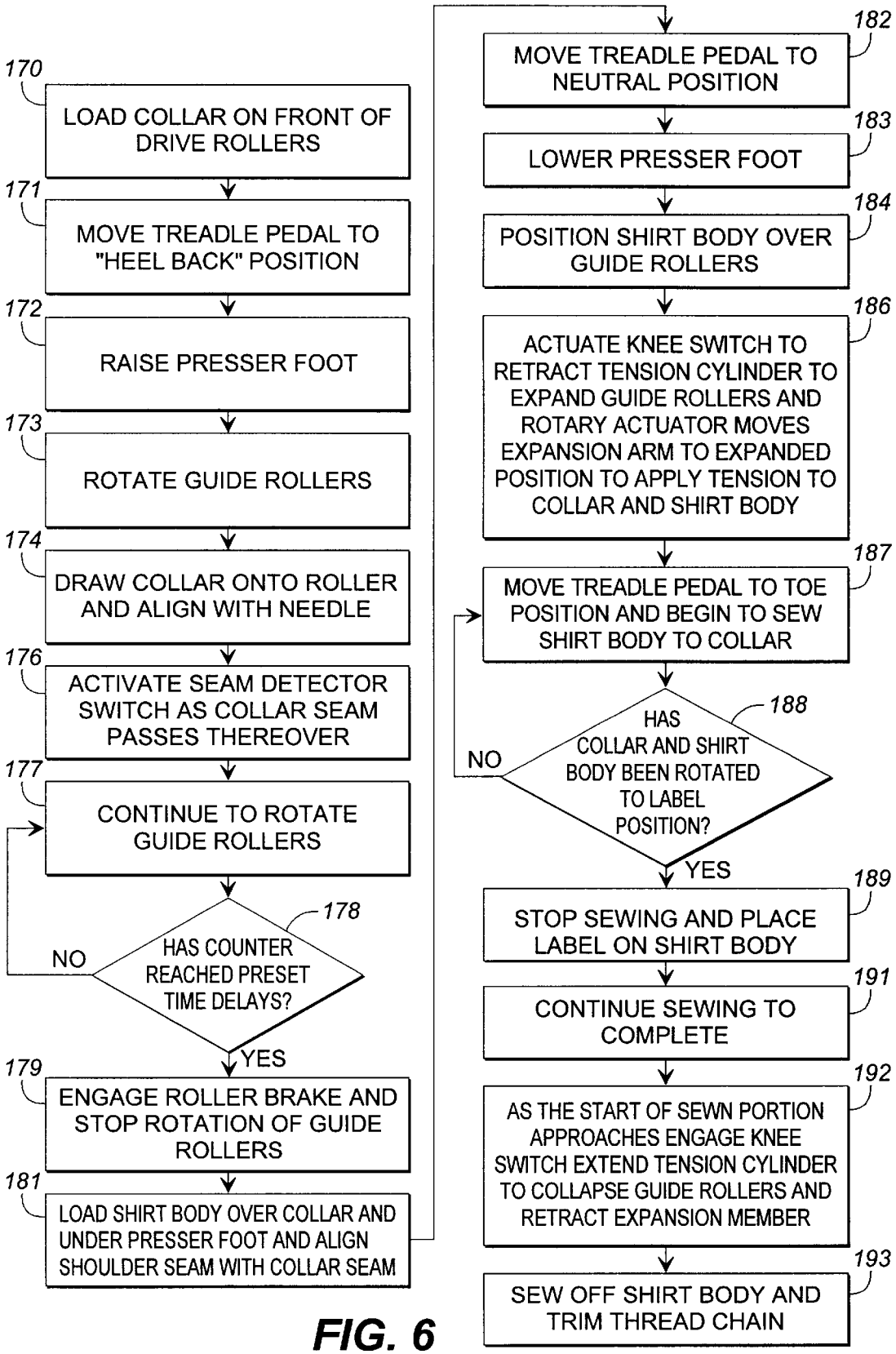
FIG. 6 is an operational flow diagram illustrating the operation of the collar sewing station with the automatic collar loading system of the present invention for use in sewing a collar having a seam to a shirt body.

FIGS. 5 and 6 are flow diagrams illustrating the operation of the collar attachment system 10 (FIG. 1) with automatic collar loading system 11, depending on whether or not the collar 12 to be sewn to a shirt body 13 has a seam 21. If there is no seam in the collar, the operator will set switch 129 to run the counter 125 to run the system for a preset time programmed into module 127 and will disable the seam detector 110 (FIG. 1). The operator will then program the system with a desired run time of between 0 to 3 seconds for the operation of the automatic collar loading system to run for a sufficient time to load the collar into a sewing position beneath the sewing needle and presser foot of the sewing machine 31 (FIG. 2) by manipulating the thumb wheel switches of the data entry module 127 (FIG. 1) to set the desired time interval. Thereafter, as an initial step 140 (FIG. 5) the operator loads the collar on the front, conical shaped portions 58 (FIG. 2) of the guide rollers 56 and 57. Due to the construction of the guide rollers, it typically is possible for the operator to load the collar on the guide rollers with one hand and without having to manipulate and guide the collar with both hands to insure that the rough or to-be-sewn edges 23 (FIG. 1) of the collar 12 are exactly aligned prior to loading.

In step 141 (FIG. 5), the operator moves the treadle pedal 47 (FIG. 1) to its heel back position. In response, the presser foot 34 (FIGS. 3A–4) is raised in step 142 (FIG. 5) while at the same time in step 143, the guide rollers are rotated for the preprogrammed, preset time delay. The rotation of the guide rollers in step 143 causes the collar to be drawn upwardly along the cone shaped portions toward the rear or cylindrical portions of the guide rollers in step 144. The collar is drawn onto the rear, cylindrical portions of the guide rollers by the engagement between the fabric of the collar and the rough surfaces 61 (FIG. 4) of the guide rollers 56 and 57, and is rotated about the sewing path 63 to automatically align the rough or to be sewn edges of the collar with the sewing needle of the sewing machine using the side surface of the sewing machine as a guide or bearing surface to thus place the collar into a sewing position beneath the presser foot and sewing needle of the sewing machine. In step 146 (FIG. 5) the machine control system checks to see whether the counter has reached the preset time delay. If not, the system continues to rotate the guide rollers and rechecks to determine when the counter has reached the preset time delay. Once the preset time delay is reached, the system proceeds to step 147 in which the drive motor for the drive roller is disengaged and the roller brake assembly 71 (FIG. 4) is engaged so that brake pad 76 engages and stops the rotation of the drive roller 56 so as to stop the rotation of the collar in its desired sewing position.

Simultaneously with the loading of the collar onto the guide rollers and into a sewing position within the sewing path, the operator can retrieve and ready a shirt body 13 (FIG. 1) for placement of the guide rollers once the collar has been automatically loaded into its sewing position. The operator thus is able to perform the two tasks simultaneously, reducing the amount of time required to efficiently and accurately load a collar and shirt body onto the collar attachment station for sewing. In step 148 (FIG. 5) the operator loads the shirt body over the collar and into a position beneath the presser foot of the sewing machine, with the circular edge of the neck opening of the shirt body being substantially matched with the rough or to be sewn edges of the collar. Thereafter in step 149, the operator moves the treadle pedal to its neutral position, which causes the presser foot to be lowered in step 151 into engagement with the shirt body prior to the start of sewing.

With the shirt body engaged by the presser foot of the sewing machine, the operator in step 152, then positions the shirt body over the guide rollers, with the circular edge of the neck opening of the shirt body circumscribed about and matched with the to-be-sewn edges of the collar. In step 153 (FIG. 5), the operator actuates the knee press switch 95 (FIG. 1), causes the tension cylinder 87 (FIG. 1) to retract its cylinder rod 88 to move the rear guide roller or idler roller 57 to its outward, expanded position to expand the guide rollers 56 and 57 and apply tension to the collar and shirt body as shown in FIG. 3B. At the same time, the control system actuates the rotary vane actuator 104 which pivots the expansion member 101 in the direction of arrow 106 into its expanded to engage and expand the collar and shirt body to place the collar and shirt body under tension as shown in FIG. 3B. The expansion of the collar and shirt body by the expansion member further provides an area or space in which the operator can grip the collar and shirt body to enable the operator to control and manipulate the collar and shirt body during a sewing operation.

With the collar and shirt body tensioned, the operator, in step 157 (FIG. 5), moves the treadle pedal to its toe forward position to begin sewing the shirt body to the collar. As the operator sews the shirt body to the collar, the operator controls and monitors the sewing of the shirt body in step 158 to determine when the shirt body has been rotated to a desired position for sewing a label thereon. Once the shirt body has been rotated to the label position, the operator stops sewing the shirt body, in step 159, and places a label on the shirt body. In step 161, the operator continues the sewing operation toward completion.

In step 162, as the sewing operation nears completion and the start of the sewn portion approaches, the operator again engages the knee press switch, which causes the tension cylinder to extend its cylinder rod to collapse the rear guide roller or idler roller 57 to its at rest position and at the same time the rotary vane actuator 104 retracts the expansion member in the direction of arrow 106' (FIG. 4) to remove the tension from the collar and shirt body as shown in FIG. 3A. Thereafter in step 163 (FIG. 5), the operator sews off the shirt body and trims away the thread chain to complete the attachment of the collar and shirt body and places the completed garment in a bin for stacking and removal prior to the start of another loading and sewing operation.

If the collar to be sewn includes a seam 21 (FIG. 1), the operation of the collar attachment station 10 with automatic collar loading system 11 as illustrated in (FIG. 6). Prior to the sewing operation, the operator sets switch 129 (FIG. 1) to run the counter for attaching a collar with a seam, and activates the seam detector 110 (FIG. 4). The operator then programs data entry module 128 (FIG. 1) of the counter 125 with a run time of between 0 to 3 seconds for which the guide rollers of the automatic collar loading system will be operated for a desired time following the detection of a seam within the collar by the seam detector 110 (FIG. 4). Once the system has been programmed, the operator, in step 170 (FIG. 6), loads the collar on the front of the guide rollers.

As discussed with respect to the operation of the system discussed with respect to FIG. 5, the operator, in a next step 171, moves the treadle pedal to its heel back position, which in turn, in step 172, causes the presser foot of the sewing machine to be raised, and in step 173, causes the guide rollers to be rotated. The engagement of the fabric of the collar with the rough surfaces of the guide rollers causes the collar to be drawn upwardly along the conical shaped front portions of the guide rollers to the rear, cylindrical portions and into a sewing path in step 174. Thereafter in step 176, as the collar is rotated about the sewing path by the rotation of the guide rollers, the seam within the collar engages and activates the seam detector as the seam passes thereover. In step 177, the guide rollers continue to rotate for the preset time delay following the detection of the seam, while in step 178 the system checks to see if the counter has reached the preset time delay following the activation of the seam detector switch. If the counter has not reached the preset time delay, the rollers continue to rotate, but if the time delay has been reached following the activation of the seam detector switch, the system, the system proceed to step 179, in which the roller brake is engaged and the drive motor deactivated to stop the rotation of the guide rollers.

In step 181 the operator loads the shirt body under the presser foot and aligns the shoulder seam of the shirt body with the collar seam. In step 182, the operator moves the treadle pedal to its neutral position, which causes, in step 183, the presser foot to be lowered into engagement with the shirt body. Thereafter, the operation of the collar attachment station functions in substantially the same fashion as discussed above with respect to FIG. 5.

In step 184, the operator positions the shirt body over the guide rollers as shown in FIG. 3A, and engages the knee press switch in step 186 (FIG. 6), in response to which the tension cylinder retracts its cylinder rod to remove the idler roller to its expanded position to apply tension to the collar and shirt body, while at the same time the rotary vane actuator is engaged and moves the expansion member to its expanded position as shown in FIG. 3B.

In step 187 (FIG. 6), the operator moves the treadle pedal to its toe forward position to begin sewing the shirt body to the collar. During the sewing operation, the operator monitors the movement of the shirt body and collar, in step 188, to see if the shirt body and collar have been rotated into a label position. If so, the operator stops the sewing operation, in step 189, and positions a label on the shirt body. In step 191, the operator then continues the sewing operation toward completion. As the sewing operation is completed, in step 192, the operator engages the knee press switch again to cause the tension cylinder to extend its cylinder rod to collapse the rear guide roller or idler roller 57 (FIG. 3A) to its rest portion and at the same time causes the expansion member to be moved to its retracted position as shown in FIG. 3A. Thereafter, in step 193 FIG. 6), the operator sews off the shirt body and trims away the thread chain from the shirt body and collar to complete the sewing of the shirt body and collar and places the finished garment in a bin or an a collector tray for removal.

It thus will be recognized by those skilled in the art that the present invention provides a system for automatically loading circular fabric collars onto a sewing station for attachment to a shirt body that significantly reduces the amount of time required for the loading of the collars on the sewing station as the operator simply places the collar about the guide rollers which then automatically draw the collar upwardly and into a sewing position beneath the needle and presser foot of the sewing machine and align the rough or to be sewn edges of the collar with the sewing machine when using the sewing machine itself as a guide or bearing edge against which the rough or to be sewn edges of the collar are guided. At the same time the automatic loading operation takes place, the operator can turn her attention to bring a shirt body for loading such that once she has the shirt body ready for loading, the collar typically will have been automatically loaded into its sewing position. As a result, the loading time for a collar attachment station is significantly reduced, thus effectively increasing the production time of the collar attachment station.

It will be further understood by those skilled in the art that while the invention has been disclosed with respect to a preferred embodiment or embodiments, various changes, modifications and additions may be made thereto without departing from the spirit and scope of the invention as set forth in the following claims.

I claim:

1. A system for automatically loading a circular collar onto a sewing station, into a position beneath a sewing head for attaching the collar to a neck opening for a shirt body, comprising:

a series of guide rollers mounted at the sewing station upstream and downstream of the sewing head for moving the collar about a sewing path, said rollers having a textured surface adapted to automatically draw the collar therealong and into a sewing position beneath the sewing head as the rollers are rotated;

a control system mounted at the sewing station for driving the rollers for a desired interval during which the collar is moved along the rollers and into its sewing position prior to the start of sewing; and an expansion member mounted adjacent one of said drive rollers along the sewing path and movable between a contracted position and an expanded position in engagement with the collar and shirt body to expand and tension the collar for sewing to the shirt body.

2. A system for automatically loading a circular collar onto a sewing station, into a position beneath a sewing head for attaching the collar to a neck opening for a shirt body, comprising:

a series of guide rollers mounted at the sewing station upstream and downstream of the sewing head for moving the collar about a sewing path, said rollers having a roughened surface for automatically drawing the collar therealong and into a sewing position beneath the sewing head as the rollers are rotated;

a control system mounted at the sewing station for driving the rollers for a desired interval during which the collar is moved along the rollers and into its sewing position prior to the start of sewing;

an expansion member mounted adjacent one of said drive rollers along the sewing path and movable between a contracted position and an expanded position in engagement with the collar and shirt body to expand and tension the collar for sewing to the shirt body; and a control switch mounted adjacent the system in a position to be engaged by an operator for causing said expansion member to be moved between its contracted and expanded positions.

3. A system for automatically loading a circular collar onto a sewing station, into a position beneath a sewing head for attaching the collar to a neck opening for a shirt body, comprising:

a series of guide rollers mounted at the sewing station upstream and downstream of the sewing head for moving the collar about a sewing path, said rollers having a roughened surface for automatically drawing the collar therealong and into a sewing position beneath the sewing head as the rollers are rotated, and wherein said rollers have a substantially conical shape;

a control system mounted at the sewing station for driving the rollers for a desired interval during which the collar is moved along the rollers and into its sewing position prior to the start of sewing; and an expansion member mounted adjacent one of said drive rollers along the sewing path and movable between a contracted position and an expanded position in engagement with the collar and shirt body to expand and tension the collar for sewing to the shirt body.

4. The system of claim 1 and further including a motor connected to one of said guide rollers for driving said guide roller to move the collar about its sewing path.

5. The system of claim 1 and further including a seam detector mounted along the sewing path in a position to detect a seam within the collar for controlling movement of the collar with the seam in a desired position along the sewing path.

6. The system of claim 2 and wherein said control switch comprises a pressure sensitive knee switch.

7. The system of claim 1 and further including an expansion cylinder connected to one of said rollers for moving said roller along the sewing path to tension the shirt body during sewing.

8. The system of claim 4 and further including a roller brake assembly for stopping rotation of said one drive roller as the collar is moved into its desired position prior to sewing.

9. A method of attaching a substantially circular collar to a shirt body, comprising the steps of:

placing the collar about a series of guide rollers;

rotating the guide rollers to move the collar about a sewing path;

as the guide rollers are rotated, automatically drawing the collar along the guide rollers and into a sewing position beneath a sewing head;

placing the shirt body over the collar on the guide rollers;

expanding the collar and shirt body; and sewing the collar to the shirt body.

10. The method of claim 9 and further including the steps of detecting a seam in the collar as the collar is rotated about its sewing path and stopping the rotation of the collar after a desired interval in response to the detection of the seam.

11. The method of claim 9 and wherein the step of rotating the guide rollers comprises driving the guide rollers for a desired number of revolutions sufficient to draw the collar along the rollers and into their sewing position, and stopping the rotation of the guide rollers after the collar has been moved to its sewing position and prior to placement of the shirt body thereover.

12. The method of claim 9 and wherein the step of expanding the collar and shirt body comprises moving an expansion member from a contracted position to an expanded position engaging the collar and urging the collar and shirt body outwardly.

13. The method of claim 9 and wherein the step of sewing the collar to the shirt body includes the step of stopping the sewing, placing a label on the collar, and finishing the sewing of the collar to the shirt body.

14. The method of claim 12 and further including the step of moving one of the guide rollers longitudinally a sufficient distance to tension the shirt body prior to sewing.

15. The method of claim 14 and further including the step of retracting the expansion member and guide roller prior to the completion of sewing to remove tension from the collar and shirt body for sewing off the shirt body.

* * * * *